US007348514B2

(12) United States Patent
Puskar et al.

(10) Patent No.: US 7,348,514 B2
(45) Date of Patent: Mar. 25, 2008

(54) SLOT MOTOR AND CIRCUIT BREAKER INCLUDING THE SAME

(75) Inventors: Michael P. Puskar, Carnegie, PA (US); William E. Beatty, Jr., Beaver, PA (US); Robert W. Mueller, Aliquippa, PA (US); Paul A. Merck, Crescent Township, PA (US); Arthur D. Carothers, Beaver Falls, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/402,789

(22) Filed: Apr. 12, 2006

(65) Prior Publication Data

US 2007/0241081 A1 Oct. 18, 2007

(51) Int. Cl.
*H01H 9/02* (2006.01)

(52) U.S. Cl. ..... 218/154; 335/6; 335/202

(58) Field of Classification Search ..... 218/153–155, 218/7, 14; 335/6–16, 147, 195, 201, 202
See application file for complete search history.

(56) References Cited

U.S. PATENT DOCUMENTS

| | | | | |
|---|---|---|---|---|
| 3,129,304 | A | 4/1964 | Hyink et al. | |
| 3,525,959 | A | 8/1970 | Ellsworth et al. | |
| 3,614,865 | A | 10/1971 | Widmer et al. | |
| 3,815,059 | A | 6/1974 | Spoelman | |
| 3,863,042 | A | 1/1975 | Nicol | |
| 4,077,025 | A | 2/1978 | Slade et al. | |
| 4,166,205 | A | 8/1979 | Maier et al. | |
| 4,540,961 | A | 9/1985 | Maier | |
| 4,642,726 | A | 2/1987 | Matsko et al. | |
| 4,710,739 | A | 12/1987 | Heyne et al. | |
| 4,963,849 | A * | 10/1990 | Kowalczyk et al. | 218/35 |
| 5,494,255 | A | 2/1996 | Pearson et al. | |
| 5,548,261 | A | 8/1996 | Ulerich et al. | |
| 5,565,828 | A | 10/1996 | Flohr | |
| 6,060,674 | A | 5/2000 | Malingowski et al. | |
| 6,281,459 | B1 * | 8/2001 | Munsch et al. | 218/22 |
| 6,831,536 | B1 | 12/2004 | Zindler | |
| 6,970,059 | B2 | 11/2005 | Mueller et al. | |

* cited by examiner

*Primary Examiner*—Elvin Enad
*Assistant Examiner*—M. Fishman
(74) *Attorney, Agent, or Firm*—Martin J. Moran

(57) ABSTRACT

A circuit breaker includes fixed and movable contacts, an operating mechanism including a movable arm carrying the movable contact, an arc chute including a plurality of spaced apart first and second arc plates, and a slot motor. A slot motor structure is disposed about the contacts and a portion of the movable arm. An insulative housing at least substantially covers and insulates the slot motor structure from the movable arm and contacts. The insulative housing includes a base and a pair of arms disposed therefrom. Each of the arms includes a first portion disposed proximate the first arc plates and a second smaller portion disposed proximate the second arc plates. A space extending from the first portion, not occupied by the second portion, is generally occupied by a portion of the second arc plates. The second portion forms a debris shield between the second arc plates and the operating mechanism.

19 Claims, 4 Drawing Sheets

SLOT MOTOR AND CIRCUIT BREAKER INCLUDING THE SAME

BACKGROUND OF THE INVENTION

1. Field of the Invention

The invention relates to electrical switching apparatus, such as, for example, circuit breakers and, more particularly, to circuit breakers including a slot motor.

2. Background Information

Circuit breakers are used to protect electrical circuitry from damage due to an overcurrent condition, such as an overload condition or a relatively high level short circuit or fault condition. Circuit breakers include at least one pair of separable contacts. A first contact is fixed within the circuit breaker housing and a second movable contact is coupled to an operating mechanism. These separable contacts are in electrical communication with either the line or the load coupled to the circuit breaker. The operating mechanism moves the movable contact between a first, open position wherein the movable contact is spaced from the fixed contact, and a second, closed position wherein the fixed and movable contacts are in contact and in electrical communication. The operating mechanism may be operated manually or by a trip mechanism.

In order to enhance the speed of separation of the separable contacts, the contacts may be disposed within a slot motor, which increases interruption performance. The slot motor is a ring-shaped, loop-shaped or U-shaped device made of magnetically permeable material (e.g., steel), which at least generally surrounds the separable contacts and a movable contact arm of the operating mechanism. When the circuit is live, an electrical arc may be drawn between the contacts during separation. The electrical current interacts electromagnetically with the slot motor to induce a magnetic field in the magnetic material of the slot motor, which, in turns, interacts with the separating contacts and the movable contact arm to accelerate the contact opening process. Examples of slot motors are disclosed in U.S. Pat. Nos. 4,375,021; 4,546,336; 4,546,337; 4,549,153; 4,970,482; 5,694,098, and 6,281,459.

Ring-shaped or loop-shaped slot motors typically have two assemblies, an upper assembly and a lower assembly. Both upper and lower assemblies include a corresponding housing and a plurality of plates composed of the magnetically permeable material. The lower assembly is disposed below the fixed contact.

Upon interruption of a short circuit or other fault condition by a circuit breaker, molten metal may be deposited throughout the internals of the circuit breaker, which may impair its performance.

Hence, there is room for improvement in electrical switching apparatus, such as circuit breakers, and in components therefor.

SUMMARY OF THE INVENTION

This need and others are met by embodiments of the invention, which provide a debris shield as part of an insulative slot motor housing. The debris shield obstructs debris from entering internal circuit breaker areas, such as the operating mechanism, where it could, otherwise, cause a functional problem. For example, extensions are disposed from a portion of the insulative slot motor housing proximate a number of the arc plates, in order to shield the internal environment of the operating mechanism from the arc chamber.

In accordance with one aspect of the invention, a circuit breaker comprises: a fixed contact; a movable contact; an operating mechanism comprising a movable arm carrying the movable contact; an arc chute comprising a plurality of spaced apart arc plates including a number of first arc plates and a number of second arc plates; and a slot motor comprising: a slot motor structure disposed about the fixed and movable contacts and a portion of the movable arm, and an insulative housing at least substantially covering the slot motor structure and insulating the slot motor structure from the movable arm and the fixed and movable contacts, the insulative housing comprising a base and a pair of arms disposed from the base, wherein each of the arms includes a first portion disposed proximate the first arc plates and a second portion disposed proximate the second arc plates, wherein a space extending from the first portion of the arms, which is not occupied by the second portion of the arms, is generally occupied by part of the arc chute including a portion of the second arc plates, and wherein the second portion of the insulative housing forms a debris shield between the second arc plates and the operating mechanism.

The first and second arc plates may include ends forming a generally arcuate path. The movable arm may have a first position wherein the fixed and movable contacts are closed and a second position wherein the fixed and movable contacts are open. The movable contact may generally follow the generally arcuate path from a position intermediate the first and second positions toward the second position. The second portion of the insulative housing may include an edge which approximates the arcuate path. The second portion of the insulative housing may obstruct debris from the second arc plates from entering the operating mechanism.

As another aspect of the invention, a slot motor comprises: a slot motor structure structured to be disposed about a fixed contact, a movable contact and a portion of a movable arm carrying the movable contact, and an insulative housing at least substantially covering the slot motor structure, the insulative housing being structured to insulate the slot motor structure from the movable arm and the fixed and movable contacts, the insulative housing comprising a base and a pair of arms disposed from the base, wherein each of the arms includes a first portion structured to be disposed proximate a number of first arc plates and a second portion structured to be disposed proximate a number of second arc plates, and wherein a space extending from the first portion of the arms, which is not occupied by the second portion of the arms, is structured to be generally occupied by part of an arc chute including a portion of the second arc plates.

As another aspect of the invention, a circuit breaker comprises: a housing; a fixed contact; a movable contact; an operating mechanism comprising a movable arm carrying the movable contact, the movable arm being pivotally mounted with respect to the housing, the movable arm having a first position wherein the fixed and movable contacts are closed and a second position wherein the fixed and movable contacts are open; an arc chute comprising a plurality of spaced apart arc plates including a number of first arc plates and a number of second arc plates; and a slot motor comprising: a slot motor structure disposed about the fixed and movable contacts and a portion of the movable arm, and an insulative housing at least substantially covering the slot motor structure and insulating the slot motor structure from the movable arm and the fixed and movable contacts, wherein the fixed contact includes a first end disposed toward the arc chute, a contact portion and a second end disposed toward the operating mechanism, wherein the movable contact includes a first end, a contact portion electrically contacting the contact portion of the fixed contact in the first position of the movable arm, a second end and a side opposite the contact portion of the movable contact, wherein the first arc plates include a first end distal from the operating mechanism and a second end facing the operating mechanism, wherein the second arc plates include a first end distal from the operating mechanism and a second end facing the operating mechanism, wherein at least one of the first arc plates is disposed proximate the first end of the fixed and movable contacts in the first position of the movable arm, wherein at least one of the second arc plates is proximate the first end of the movable contact in the second position of the movable arm, wherein a portion of at least one of the second arc plates is disposed distal from the fixed contact and beyond the side opposite the contact portion of the movable contact, wherein the insulative housing is generally disposed between the arc chute and the operating mechanism, wherein the insulative housing includes a first portion proximate the second end of the first arc plates, wherein the insulative housing includes a second portion proximate the second end of the second arc plates, and wherein the second portion is smaller than the first portion of the insulative housing.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

The invention is disclosed in association with a three-pole circuit breaker, although the invention is applicable to a wide range of circuit breakers having any number of poles.

Figure 1:
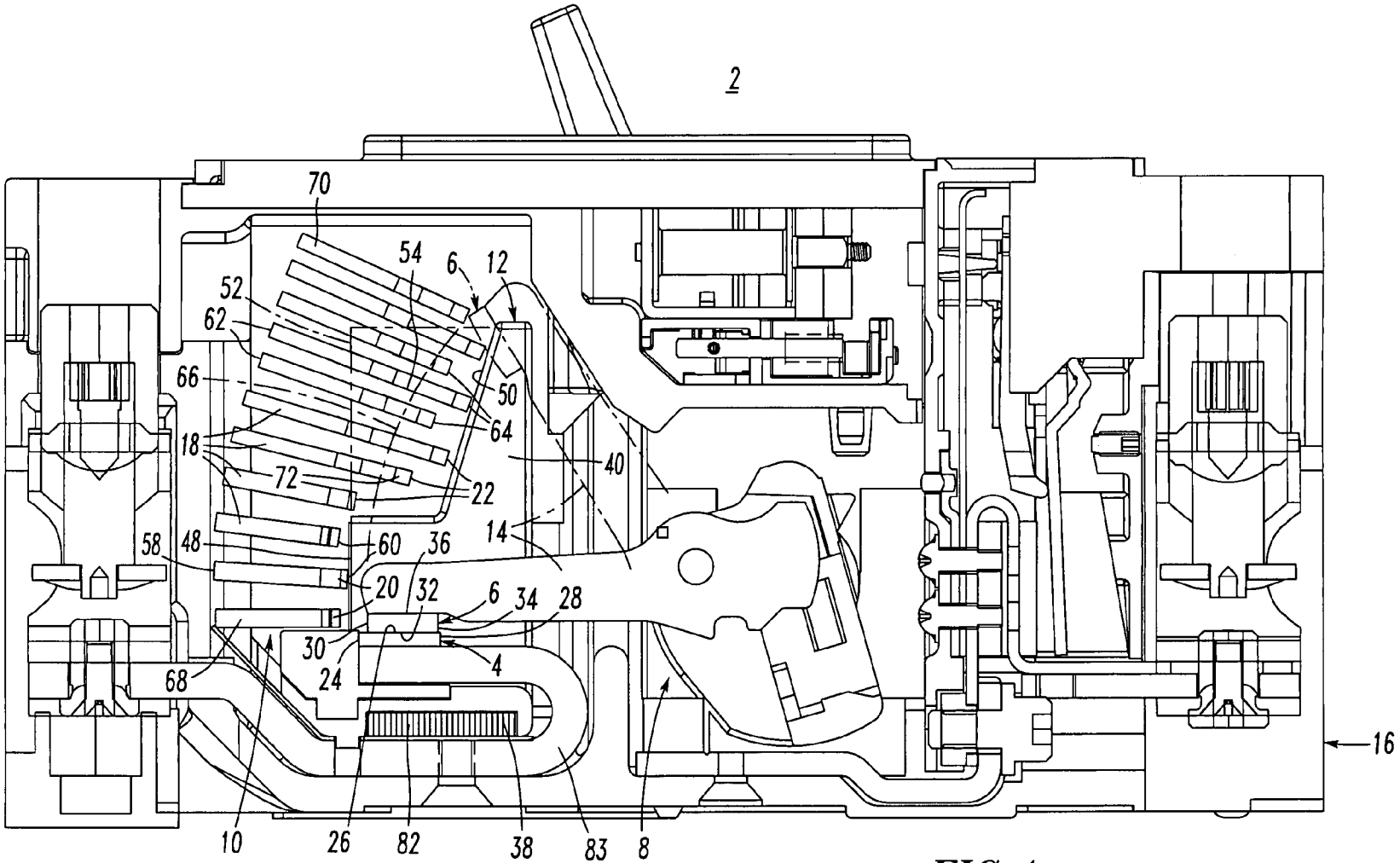
FIG. 1 is a vertical elevation view of a circuit breaker in accordance with an embodiment of the invention.

Referring to FIG. 1, a circuit breaker 2 includes a fixed contact 4, a movable contact 6, an operating mechanism 8, an arc chute 10 and a slot motor 12. The operating mechanism 8 includes a movable arm 14 carrying the movable contact 6. The movable arm 8, which is pivotally mounted with respect to molded housing 16, has a first closed position wherein the fixed and movable contacts 4,6 are closed and a second open position (shown in phantom line drawing) wherein the fixed and movable contacts 4,6 are open. The arc chute 10 includes a plurality of spaced apart arc plates 18 including a number of first arc plates 20 and a number of second arc plates 22.

The fixed contact 4 includes a first end 24 disposed toward the arc chute 10, a contact portion 26 and a second end 28 disposed toward the operating mechanism 8. The movable contact 6 includes a first end 30, a contact portion 32 electrically contacting the contact portion 26 of the fixed contact 4 in the first closed position of the movable arm 14, a second end 34 and a side 36 opposite the contact portion 32 of the movable contact 6.

Figure 2:
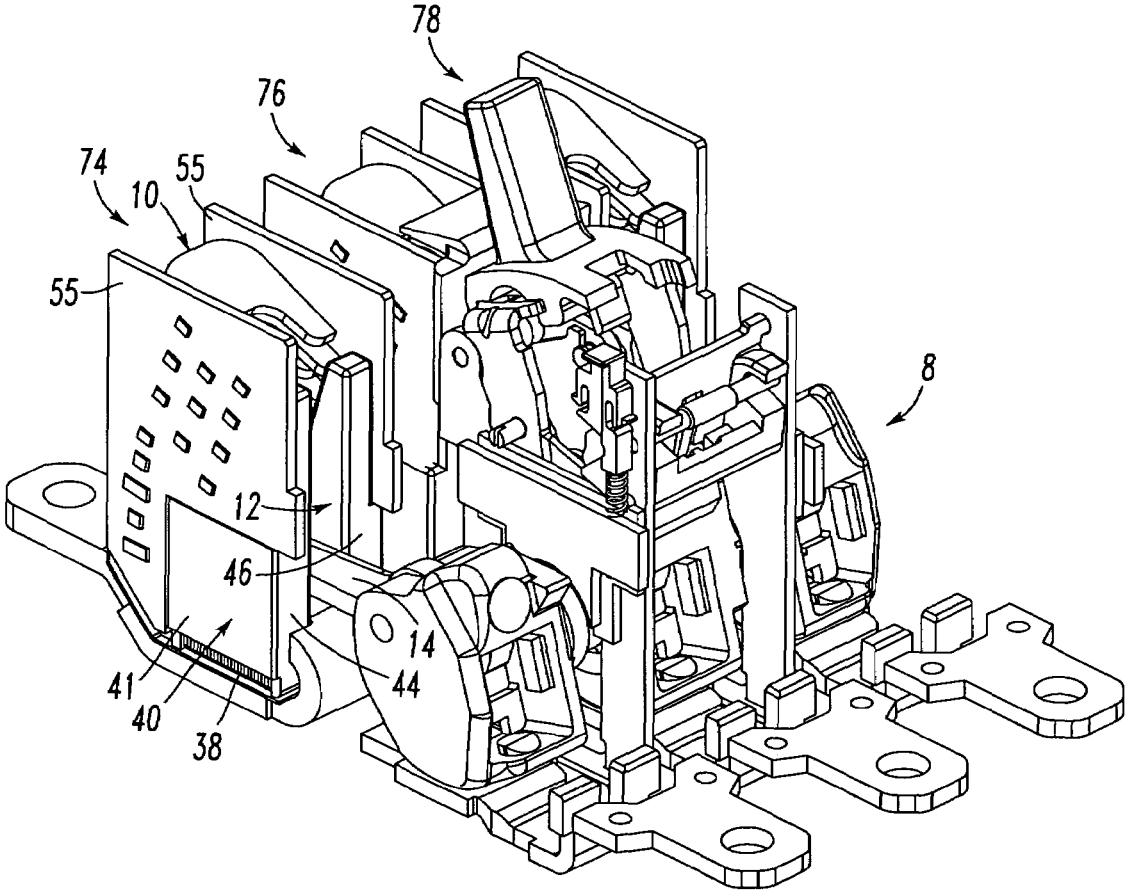
FIG. 2 is an isometric view of the operating mechanism and three poles of the circuit breaker of FIG. 1.
Figure 4:
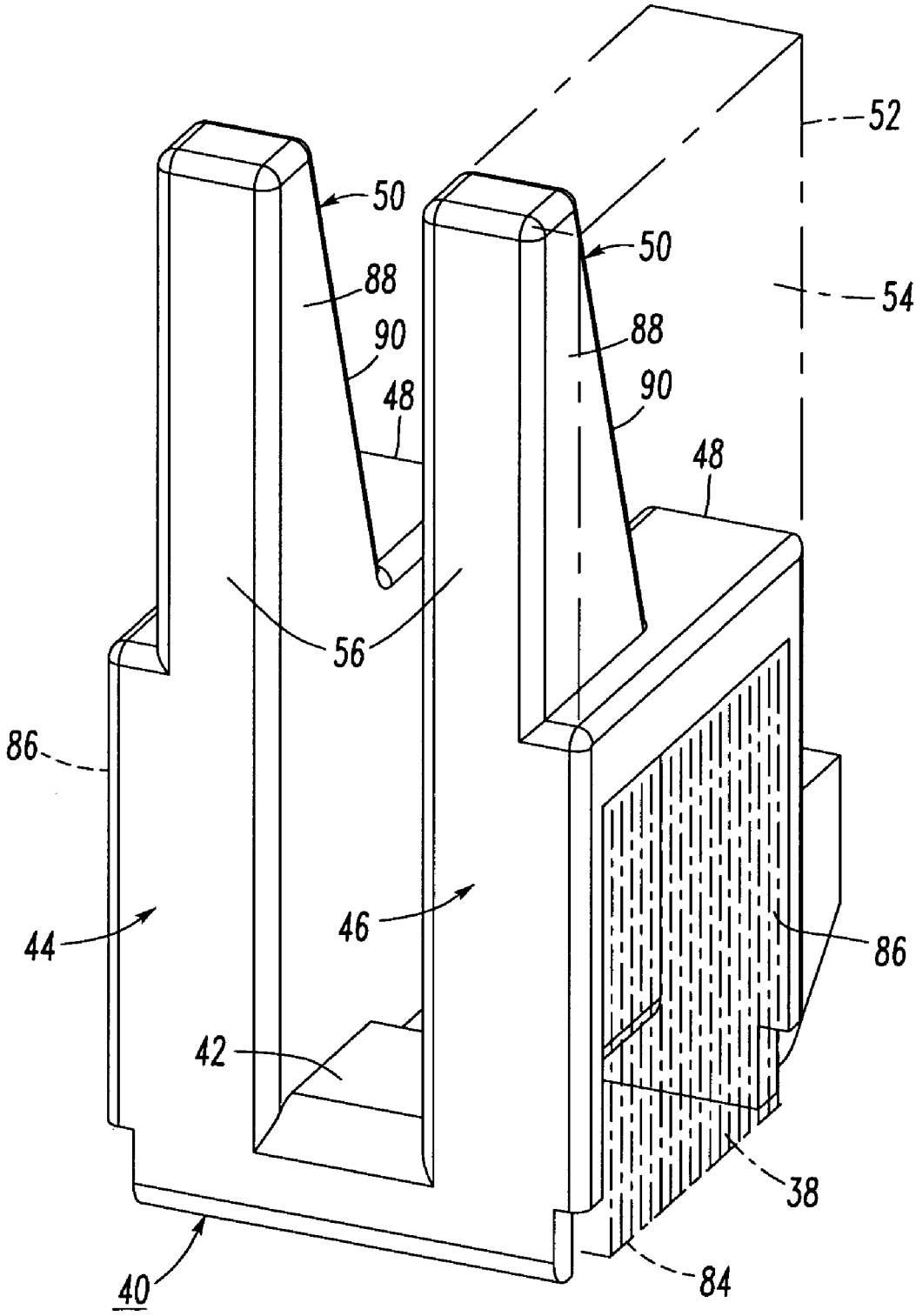
FIG. 4 is an isometric view of the slot motor housing of the circuit breaker of FIG. 1.

Also referring to FIG. 4, the slot motor 12 (FIG. 1) includes a slot motor structure 38 (e.g., made of steel; made of steel laminations) (shown in phantom line drawing in FIG. 4) disposed about the fixed and movable contacts 4,6 and a portion of the movable arm 14, and an insulative housing 40 (as best shown in FIG. 4). The insulative housing 40 at least substantially covers the slot motor structure 38 and insulates the slot motor structure from the movable arm 14 and the fixed and movable contacts 4,6. Preferably, any exposed areas of the slot motor structure 38 are covered by a suitable insulative tape 41 as shown in FIG. 2. Alternatively, the insulative housing 40 may be molded to cover (not shown) the arms 86 (FIG. 4) of the slot motor structure 38. The insulative housing 40 includes a base 42 and a pair of arms 44,46 disposed from the base. Each of the arms 44,46 includes a first portion 48 disposed proximate a number of the first arc plates 20 and a second portion 50 disposed proximate a number of the second arc plates 22. The second portion 50 is smaller than the first portion 48. A space 52 (shown in phantom line drawing extended from the first portion 48 of the arm 46) extending from the first portion 48 of the arms 44,46, which is not occupied by the second portion 50 thereof, is generally occupied by a side wall 55 (FIG. 2) of the arc chute 10 and a portion 54 of the second arc plates 22. The second portion 50 of the arms 44,46 forms a debris shield 56 between the second arc plates 22 and the operating mechanism 14.

The first arc plates 20 include a first end 58 distal from the operating mechanism 14 and a second end 60 facing the operating mechanism. The second arc plates 22 include a first end 62 distal from the operating mechanism 14 and a second end 64 facing the operating mechanism. The second ends 60,64 of the first and second arc plates 20,22 form a generally arcuate path 66. The first end 30 of the movable contact 6 generally follows the generally arcuate path 66 from a position intermediate the first closed position (as shown in FIG. 1) and the second open position (as shown in phantom line drawing in FIG. 1) toward the second open position. At least one of the first arc plates 20, such as arc plate 68, is disposed proximate the first end 24 of the fixed contact 4 and the first end 30 of the movable contact 6 in the first closed position of the movable arm 14. At least one of the second arc plates 22, such as arc plate 70, is proximate the first end 30 of the movable contact 6 in the second open position of the movable arm 14. A portion 72 of at least one of the second arc plates 22 is disposed distal from the fixed contact 4 and beyond the side 36 opposite the contact portion 32 of the movable contact 6. In other words, in the example of FIG. 1, the portion 72 of at least one of the second arc plates 22 is disposed above (with respect to FIG. 1) the fixed contact 4.

FIG. 2 shows the operating mechanism 8 and three poles 74,76,78 of the circuit breaker 2 of FIG. 1. Each of these poles, as shown with pole 74, includes corresponding ones of the arc chute 10, the slot motor 12, the movable arm 14 and the separable contacts 4,6 (FIG. 1).

Figure 3:
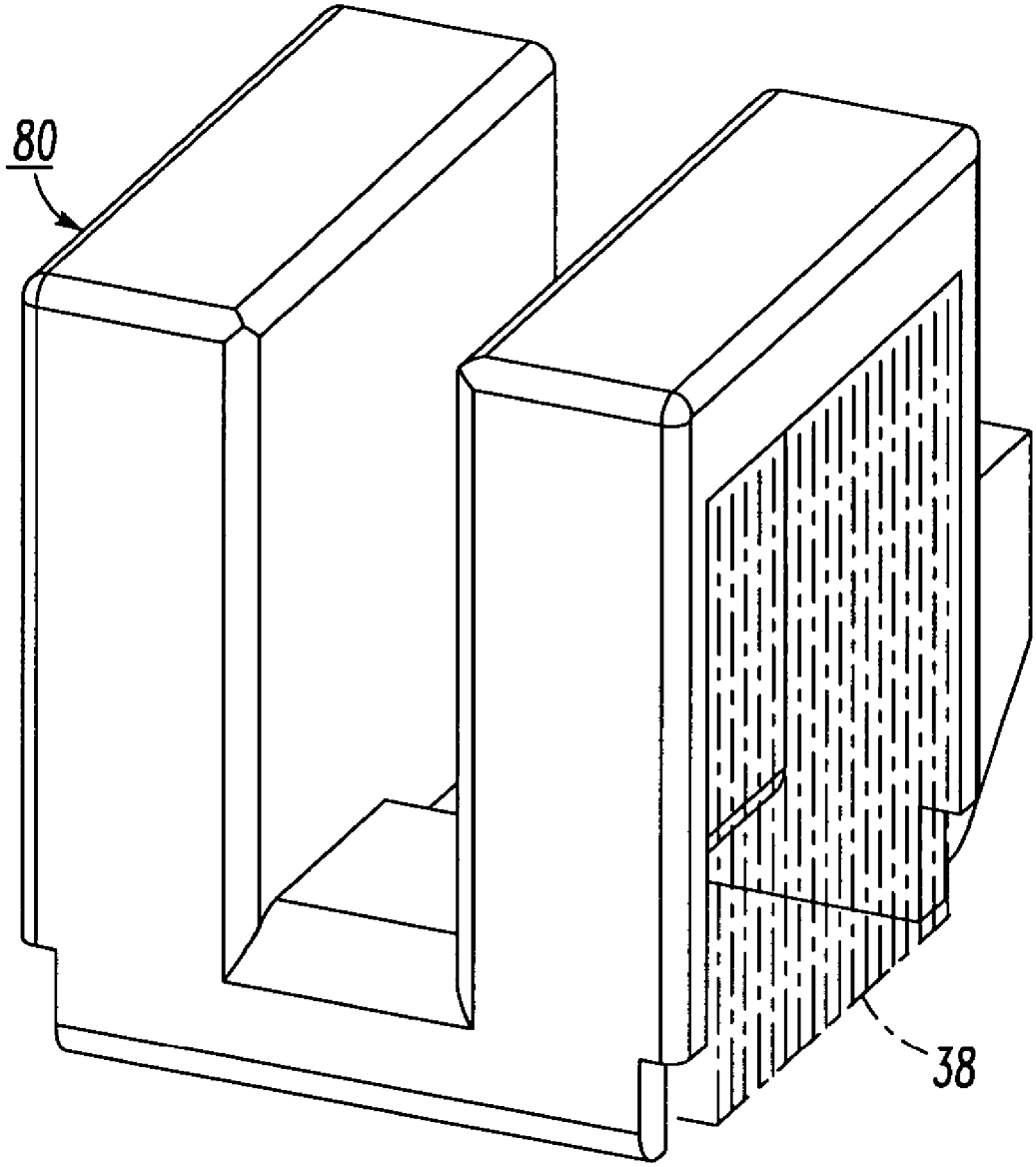
FIG. 3 PRIOR ART
FIG. 3 is an isometric view of a slot motor housing.

FIG. 3 shows a low-profile insulative slot motor housing 80 and the steel laminations 38 (shown in phantom line drawing) therefor. Unlike the insulative housing 40 (as best shown in FIG. 4), the insulative housing 80 does not include the second portion 50 which forms the debris shield 56 between the second arc plates 22 and the operating mechanism 14.

As shown in FIG. 4, the insulative slot motor housing 40 at least substantially covers the U-shaped slot motor laminations 38 (shown in phantom line drawing), thereby insulating the same from the fixed and movable contacts 4,6 and from the movable arm 14 of FIG. 1. As shown in FIG. 1, the bottoms 82 of the generally U-shaped laminations 38 are under the fixed contact 4, which is carried by the reverse loop conductor 83. As is well known, the laminations 38 are disposed about the fixed contact 4, the movable contact 6 and a portion of the movable arm 14. The steel laminations 38 form a slot motor structure including a base 84 and two arms 86, with the base 84 being disposed opposite the contact portion 26 of the fixed contact 4 and with the arms 86 extending toward the second end 64 of the second arc plates 22.

As shown in FIGS. 1 and 2, the insulative slot motor housing 40 is generally disposed between the arc chute 10 and the operating mechanism 8, with the first portion 48 being proximate the second end 60 of the first arc plates 20 and the second portion 50 being proximate the second end 64 of the second arc plates 22.

As best shown in FIG. 4, the slot motor housing 40 includes a generally U-shape, as formed by the base 42 and arms 44,46, corresponding to the U-shaped laminations 38. The insulative housing second portion 50 includes for each of the arms 44,46 a triangular-shaped structure 88 forming a portion of the debris shield 56, which obstructs debris from the second arc plates 22 from entering the operating mechanism 8. The edges 90 of the triangular-shaped structure 88 approximate the generally arcuate path 66 (FIG. 2) and the second ends 64 of the second arc plates 22.

EXAMPLE

A non-limiting example of the insulation material of the slot motor housing 40 is a suitable glass filled polyester. One example is Rosite®3550D, which is marketed by Industrial Dielectrics, Inc. of Noblesville, Ind. This material preferably provides some out-gassing responsive to an arcing event.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is Claimed is:

1. A circuit breaker comprising:

a fixed contact;

a movable contact;

an operating mechanism comprising a movable arm carrying said movable contact;

an arc chute comprising a plurality of spaced apart arc plates including a number of first arc plates and a number of second arc plates; and a slot motor comprising:

a slot motor structure disposed about said fixed and movable contacts and a portion of said movable arm, and an insulative housing at least substantially covering said slot motor structure and insulating said slot motor structure from said movable arm and said fixed and movable contacts, said insulative housing comprising a base and a pair of arms disposed from said base, wherein each of said arms includes a first portion disposed proximate said first arc plates and a second portion disposed proximate said second arc plates, wherein a space extending from said first portion of said arms, which is not occupied by said second portion of said arms, is generally occupied by part of said arc chute including a portion of said second arc plates, and wherein said second portion of said arms forms a debris shield between said second arc plates and said operating mechanism.

2. The circuit breaker of claim 1 wherein the base and arms of said insulative housing have a generally U-shape; and wherein the second portion of said insulative housing includes for each of said arms a triangular-shaped structure forming a portion of said debris shield.

3. The circuit breaker of claim 1 wherein said first and second arc plates include ends forming a generally arcuate path; wherein said movable arm has a first position wherein said fixed and movable contacts are closed and a second position wherein said fixed and movable contacts are open; wherein said movable contact generally follows said generally arcuate path from a position intermediate said first and second positions toward said second position; and wherein the second portion of said insulative housing includes an edge which approximates said generally arcuate path.

4. The circuit breaker of claim 3 wherein the second portion of said insulative housing obstructs debris from said second arc plates from entering said operating mechanism.

5. The circuit breaker of claim 3 wherein the second portion of said insulative housing comprises two triangular-shaped structures structured to form said debris shield.

6. The circuit breaker of claim 1 wherein said slot motor structure comprises a plurality of steel laminations.

7. The circuit breaker of claim 1 wherein said insulative housing is made of a glass filled polyester.

8. A slot motor comprising:

a slot motor structure structured to be disposed about a fixed contact, a movable contact and a portion of a movable arm carrying said movable contact, and an insulative housing at least substantially covering said slot motor structure, said insulative housing being structured to insulate said slot motor structure from said movable arm and said fixed and movable contacts, said insulative housing comprising a base and a pair of arms disposed from said base, wherein each of said arms includes a first portion structured to be disposed proximate a number of first arc plates and a second portion structured to be disposed proximate a number of second arc plates, and wherein a space extending from said first portion of said arms, which is not occupied by said second portion of said arms, is structured to be generally occupied by part of an arc chute including a portion of said second arc plates.

9. The slot motor of claim 8 wherein said insulative housing includes a generally U-shape having said base and said pair of arms; and wherein the second portion of said arms includes for each of said arms a triangular-shaped structure structured to form a portion of a debris shield.

10. The slot motor of claim 8 wherein said slot motor structure comprises a plurality of generally U-shaped laminations; and wherein said insulative housing includes a general U-shape corresponding to said U-shaped laminations.

11. The slot motor of claim 8 wherein the second portion of said arms includes an edge which approximates a generally arcuate path.

12. The slot motor of claim 8 wherein the second portion of said arms comprises two triangular-shaped structures forming a debris shield.

13. The slot motor of claim 8 wherein said insulative housing includes a generally U-shape having said base and said pair of arms; and wherein the second portion of said arms includes for each of said arms a structure which forms a portion of a debris shield and which has an edge that approximates a generally arcuate path.

14. The slot motor of claim 8 wherein said insulative housing is made of a glass filled polyester structured to out-gas responsive to an arcing event.

15. A circuit breaker comprising:

a housing;

a fixed contact;

a movable contact;

an operating mechanism comprising a movable arm carrying said movable contact, said movable arm being pivotally mounted with respect to said housing, said movable arm having a first position wherein said fixed and movable contacts are closed and a second position wherein said fixed and movable contacts are open:

an arc chute comprising a plurality of spaced apart arc plates including a number of first arc plates and a number of second arc plates; and a slot motor comprising:

a slot motor structure disposed about said fixed and movable contacts and a portion of said movable arm, and an insulative housing at least substantially covering said slot motor structure and insulating said slot motor structure from said movable arm and said fixed and movable contacts, wherein said fixed contact includes a first end disposed toward said arc chute, a contact portion and a second end disposed toward said operating mechanism, wherein said movable contact includes a first end, a contact portion electrically contacting the contact portion of said fixed contact in the first position of said movable arm, a second end and a side opposite the contact portion of said movable contact, wherein said first arc plates include a first end distal from said operating mechanism and a second end facing said operating mechanism, wherein said second arc plates include a first end distal from said operating mechanism and a second end facing said operating mechanism, wherein at least one of said first arc plates is disposed proximate the first end of said fixed and movable contacts in the first position of said movable arm, wherein at least one of said second arc plates is proximate the first end of said movable contact in the second position of said movable arm, wherein a portion of at least one of said second arc plates is disposed distal from said fixed contact and beyond the side opposite the contact portion of said movable contact, wherein said insulative housing is generally disposed between said arc chute and said operating mechanism, wherein said insulative housing includes a first portion proximate the second end of said first arc plates, wherein said insulative housing includes a second portion proximate the second end of said second arc plates, wherein said second portion is smaller than said first portion of said insulative housing; and wherein said insulative housing includes a generally U-shape having a base and two arms; and wherein the second portion of said insulative housing includes for each of said arms a triangular-shaped structure structured to provide a portion of a debris shield between said second arc plates and said operating mechanism.

16. A circuit breaker comprising:

a housing;

a fixed contact;

a movable contact;

an operating mechanism comprising a movable arm carrying said movable contact, said movable arm being pivotally mounted with respect to said housing, said movable arm having a first position wherein said fixed and movable contacts are closed and a second position wherein said fixed and movable contacts are open;

an arc chute comprising a plurality of spaced apart arc plates including a number of first arc plates and a number of second arc plates; and a slot motor comprising:

a slot motor structure disposed about said fixed and movable contacts and a portion of said movable arm, and an insulative housing at least substantially covering said slot motor structure and insulating said slot motor structure from said movable arm and said fixed and movable contacts, wherein said fixed contact includes a first end disposed toward said arc chute, a contact portion and a second end disposed toward said operating mechanism, wherein said movable contact includes a first end, a contact portion electrically contacting the contact portion of said fixed contact in the first position of said movable arm, a second end and a side opposite the contact portion of said movable contact, wherein said first arc plates include a first end distal from said operating mechanism and a second end facing said operating mechanism, wherein said second arc plates include a first end distal from said operating mechanism and a second end facing said operating mechanism, wherein at least one of said first arc plates is disposed proximate the first end of said fixed and movable contacts in the first position of said movable arm, wherein at least one of said second arc plates is proximate the first end of said movable contact in the second position of said movable arm, wherein a portion of at least one of said second arc plates is disposed distal from said fixed contact and beyond the side opposite the contact portion of said movable contact, wherein said insulative housing is generally disposed between said arc chute and said operating mechanism, wherein said insulative housing includes a first portion proximate the second end of said first arc plates, wherein said insulative housing includes a second portion proximate the second end of said second arc plates, wherein said second portion is smaller than said first portion of said insulative housing;

wherein said slot motor structure comprises a plurality of generally U-shaped laminations; and wherein said insulative housing includes a general U-shape corresponding to said U-shaped laminations; and wherein said U-shaped laminations include a base and two arms, said base being disposed opposite the contact portion of said fixed contact, said arms extending toward the second end of said second arc plates.

17. A circuit breaker comprising:

a housing;

a fixed contact;

a movable contact; an operating mechanism comprising a movable arm carrying said movable contact, said movable arm being pivotally mounted with respect to said housing, said movable arm having a first position wherein said fixed and movable contacts are closed and a second position wherein said fixed and movable contacts are open;

an arc chute comprising a plurality of spaced apart arc plates including a number of first arc plates and a number of second arc plates; and a slot motor comprising:

a slot motor structure disposed about said fixed and movable contacts and a portion of said movable arm, and an insulative housing at least substantially covering said slot motor structure and insulating said slot motor structure from said movable arm and said fixed and movable contacts, wherein said fixed contact includes a first end disposed toward said arc chute, a contact portion and a second end disposed toward said operating mechanism, wherein said movable contact includes a first end, a contact portion electrically contacting the contact portion of said fixed contact in the first position of said movable arm, a second end and a side opposite the contact portion of said movable contact, wherein said first arc plates include a first end distal from said operating mechanism and a second end facing said operating mechanism, wherein said second arc plates include a first end distal from said operating mechanism and a second end facing said operating mechanism, wherein at least one of said first arc plates is disposed proximate the first end of said fixed and movable contacts in the first position of said movable arm, wherein at least one of said second arc plates is proximate the first end of said movable contact in the second position of said movable arm, wherein a portion of at least one of said second arc plates is disposed distal from said fixed contact and beyond the side opposite the contact portion of said movable contact, wherein said insulative housing is generally disposed between said arc chute and said operating mechanism, wherein said insulative housing includes a first portion proximate the second end of said first arc plates, wherein said insulative housing includes a second portion proximate the second end of said second arc plates, wherein said second portion is smaller than said first portion of said insulative housing; and wherein the second ends of said first and second arc plates form a generally arcuate path; wherein the first end of said movable contact generally follows said generally arcuate path from a position intermediate said first and second positions toward said second position; and wherein the second portion of said insulative housing includes an edge which approximates said generally arcuate path.

18. A circuit breaker comprising:

a housing;

a fixed contact;

a movable contact;

an operating mechanism comprising a movable arm carrying said movable contact, said movable arm being pivotally mounted with respect to said housing, said movable arm having a first position wherein said fixed and movable contacts are closed and a second position wherein said fixed and movable contacts are open;

an arc chute comprising a plurality of spaced apart arc plates including a number of first arc plates and a number of second arc plates; and a slot motor comprising:

a slot motor structure disposed about said fixed and movable contacts and a portion of said movable arm, and an insulative housing at least substantially covering said slot motor structure and insulating said slot motor structure from said movable arm and said fixed and movable contacts, wherein said fixed contact includes a first end disposed toward said arc chute, a contact portion and a second end disposed toward said operating mechanism, wherein said movable contact includes a first end, a contact portion electrically contacting the contact portion of said fixed contact in the first position of said movable arm, a second end and a side opposite the contact portion of said movable contact, wherein said first arc plates include a first end distal from said operating mechanism and a second end facing said operating mechanism, wherein said second arc plates include a first end distal from said operating mechanism and a second end facing said operating mechanism, wherein at least one of said first arc plates is disposed proximate the first end of said fixed and movable contacts in the first position of said movable arm, wherein at least one of said second arc plates is proximate the first end of said movable contact in the second position of said movable arm, wherein a portion of at least one of said second arc plates is disposed distal from said fixed contact and beyond the side opposite the contact portion of said movable contact, wherein said insulative housing is generally disposed between said arc chute and said operating mechanism, wherein said insulative housing includes a first portion proximate the second end of said first arc plates, wherein said insulative housing includes a second portion proximate the second end of said second arc plates, wherein said second portion is smaller than said first portion of said insulative housing; and wherein the second portion of said insulative housing comprises two triangular-shaped structures structured to provide a debris shield between said second arc plates and said operating mechanism.

19. A circuit breaker comprising:

a housing;

a fixed contact:

a movable contact;

an operating mechanism comprising a movable arm carrying said movable contact, said movable arm being pivotally mounted with respect to said housing, said movable arm having a first position wherein said fixed and movable contacts are closed and a second position wherein said fixed and movable contacts are open;

an arc chute comprising a plurality of spaced apart arc plates including a number of first arc plates and a number of second arc plates; and a slot motor comprising:

a slot motor structure disposed about said fixed and movable contacts and a portion of said movable arm, and an insulative housing at least substantially covering said slot motor structure and insulating said slot motor structure from said movable arm and said fixed and movable contacts, wherein said fixed contact includes a first end disposed toward said arc chute, a contact portion and a second end disposed toward said operating mechanism, wherein said movable contact includes a first end, a contact portion electrically contacting the contact portion of said fixed contact in the first position of said movable arm, a second end and a side opposite the contact portion of said movable contact, wherein said first arc plates include a first end distal from said operating mechanism and a second end facing said operating mechanism, wherein said second arc plates include a first end distal from said operating mechanism and a second end facing said operating mechanism, wherein at least one of said first arc plates is disposed proximate the first end of said fixed and movable contacts in the first position of said movable arm, wherein at least one of said second arc plates is proximate the first end of said movable contact in the second position of said movable arm, wherein a portion of at least one of said second arc plates is disposed distal from said fixed contact and beyond the side opposite the contact portion of said movable contact, wherein said insulative housing is generally disposed between said arc chute and said operating mechanism, wherein said insulative housing includes a first portion proximate the second end of said first arc plates, wherein said insulative housing includes a second portion proximate the second end of said second arc plates, wherein said second portion is smaller than said first portion of said insulative housing; and wherein said insulative housing includes a generally U-shape having a base and two arms; wherein the second ends of said first and second arc plates form a generally arcuate path; wherein the first end of said movable contact generally follows said generally arcuate path from a position intermediate said first and second positions toward said second position; and wherein the second portion of said insulative housing includes for each of said arms a structure which includes an edge that approximates said generally arcuate path, in order to provide a debris shield between said second arc plates and said operating mechanism.

* * * * *